US010871057B2

(12) United States Patent
Chochua et al.

(10) Patent No.: US 10,871,057 B2
(45) Date of Patent: Dec. 22, 2020

(54) FLOW CONTROL DEVICE FOR A WELL

(71) Applicant: Schlumberger Technology Corporation, Sugar Land, TX (US)

(72) Inventors: Gocha Chochua, Sugar Land, TX (US); Aleksandar Rudic, Rosharon, TX (US); Ke Ken Li, Missouri City, TX (US); Terje Moen, Sandnes (NO); Carlos Alberto Araque, Cambridge (GB); Barbara J. A. Zielinska, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 295 days.

(21) Appl. No.: 15/195,394

(22) Filed: Jun. 28, 2016

(65) Prior Publication Data

US 2017/0002625 A1 Jan. 5, 2017

Related U.S. Application Data

(60) Provisional application No. 62/186,997, filed on Jun. 30, 2015, provisional application No. 62/190,118, filed on Jul. 8, 2015, provisional application No. 62/190,129, filed on Jul. 8, 2015.

(51) Int. Cl.
*E21B 43/12* (2006.01)
*E21B 34/08* (2006.01)

(52) U.S. Cl.
CPC ..... *E21B 43/12* (2013.01); *E21B 34/08* (2013.01)

(58) Field of Classification Search
CPC ..... E21B 34/06; E21B 34/08; E21B 43/12
See application file for complete search history.

(56) References Cited

U.S. PATENT DOCUMENTS

| | | | |
|---|---|---|---|
| 8,485,258 | B2 | 7/2013 | Mathiesen et al. |
| 8,517,099 | B2 | 8/2013 | Mathiesen et al. |
| 8,534,355 | B2 | 9/2013 | Johannesen |
| 8,590,630 | B2 | 11/2013 | Mathiesen et al. |
| 8,820,413 | B2 | 9/2014 | Mathiesen et al. |
| 8,820,414 | B2 | 9/2014 | Mathiesen et al. |
| 8,875,797 | B2 | 11/2014 | Aakre et al. |
| 9,038,649 | B2 | 5/2015 | Aakre et al. |

(Continued)

OTHER PUBLICATIONS

Aakre, H., et al "Smart Well with Autonomous Inflow Control Valve Technology," SPE 164348, presented at the SPE Middle East Oil and Gas Show and Exhibition, Manama, Bahrain, 2013, 8 pages.

(Continued)

*Primary Examiner* — Robert E Fuller
*Assistant Examiner* — Lamia Quaim
(74) *Attorney, Agent, or Firm* — Kelly McKinney

(57) ABSTRACT

An apparatus that is usable with a well includes a housing and a body. The housing includes an inlet and an outlet, and a fluid flow is communicated between the inlet and outlet. The body disposed inside the housing to form a fluid restriction for the fluid flow. The body includes an opening therethrough to divert a first portion of the fluid flow into a first fluid flow path; and a first surface to at least partially define the first fluid flow path. The body is adapted to move to control fluid communication through the first flow path based at least in part on at least one fluid property of the flow.

13 Claims, 11 Drawing Sheets

(56) References Cited

U.S. PATENT DOCUMENTS

| | | | | |
|---|---|---|---|---|
| 9,279,309 | B2 | 3/2016 | Werswick et al. | |
| 9,366,108 | B2 | 6/2016 | Aakre et al. | |
| 9,534,470 | B2 | 1/2017 | Aakre et al. | |
| 9,624,759 | B2 | 4/2017 | Mathiesen et al. | |
| 2006/0027377 | A1 | 2/2006 | Schoonderbeek et al. | |
| 2007/0272408 | A1 | 11/2007 | Zazovsky et al. | |
| 2008/0217001 | A1 | 9/2008 | Dybevik et al. | |
| 2009/0078428 | A1 | 3/2009 | Ali | |
| 2009/0218103 | A1* | 9/2009 | Aakre | E21B 34/08 166/373 |
| 2013/0180724 | A1 | 7/2013 | Nguyen | |
| 2013/0277059 | A1* | 10/2013 | Holderman | E21B 34/08 166/319 |
| 2015/0040990 | A1* | 2/2015 | Mathiesen | G05D 7/01 137/12 |

OTHER PUBLICATIONS

Fripp, M., et al, "The Theory of a Fluidic Diode Autonomous Inflow Control Device," SPE 167415 presented at the SPE Middle East Intelligent Energy Conference and Exhibition, Dubai, UAE, 2013, 9 pages.

Halvorsen, Martin, et al, "Increased oil production at Troll by autonomous inflow control with RCP valves", SPE159634, presented at the SPE Annual Technical Conference and Exhibition, San Antonio, Texas, United States of America, 2012, 16 pages.

Least, B. et al "Autonomous ICD Single Phase Testing", SPE 160165, presented at the SPE Annual Technical Conference and Exhibition, San Antonio, Texas, United States of America, 2012, 9 pages.

Least, B., et al "Inflow Control Devices Improve Production in Heavy Oil Wells," SPE 167414, presented at the SPE Middle East Intelligent Energy Conference and Exhibition, Dubai, UAE, 2013, 11 pages.

Mathiesen, V., et al "The Autonomous RCP Valve—New Technology for Inflow Control in Horizontal Wells", SPE 145737, presented at the SPE Offshore Europe Oil and Gas Conference and Exhibition, Aberdeen, United Kingdom, 2011, 10 pages.

Moen, T. et al., "Inflow Control Device and Near-Wellbore Interaction," SPE 112471, presented at the SPE International Symposium and Exhibition on Formation Damage Control, Lafayette, Louisiana, United States of America, 2008, 8 pages.

"ResFlow Well Production Management System," retrieved from [http://www.slb.com/~/media/Files/sand_control/product_sheets/resflow] retrieved Jan. 24, 2019, 4 pages.

"Moody Chart" retrieved from [http://en.wikipedia.org/wiki/Moody_chart] last edited on Nov. 30, 2018, retrieved on Jan. 24, 2019, 3 pages.

Munson, B. et al.,"Viscous Flow in Pipes," Chapter 8, "Fundamentals of Fluid Mechanics, Second Edition," 1994, p. 492, John Wiley.

Edward, B. et al., "Production Transformation in Horizontal Wells' Oil Recovery and Revival in Shallow Volcanic Fractured Reservoir by ICD's OH Completions Success, Central Thailand," SPE/IPTC 16872, International Petroleum Technology Conference, Mar. 26-28, 2013, 9 pages, Beijing, China.

Tran, T. et al, "Attic Thin Oil Columns Horizontal Wells Optimization Through Advance Application of ICD's and Well Placement Technologies in South China," IADC/SPE 126675, 2010 IADC/SPE Drilling Conference and Exhibition, Feb. 2-4, 2010, 20 pages, New Orleans, Louisiana, United States of America.

International Search Report and Written Opinion of International Patent Application No. PCT/US2016/040229 dated Sep. 12, 2016, 17 pages.

International Preliminary Report on Patentability of International Patent Application No. PCT/US2016/040229 dated Jan. 2, 2018, 12 pages.

Christopher E. Brennen, (1994) Radial and Rotordynamic Forces, Chapter 10, Hydrodynamics of Pumps (37 pages).

* cited by examiner

FLOW CONTROL DEVICE FOR A WELL

CROSS-REFERENCE TO RELATED APPLICATION

This application claims the benefit of U.S. Provisional Patent Application Ser. No. 62/186,997 filed Jun. 30, 2015, U.S. Provisional Patent Application Ser. No. 62/190,118 filed Jul. 8, 2015 and U.S. Provisional Patent Application Ser. No. 62/190,129 filed Jul. 8, 2015. Each of the aforementioned related patent applications are herein incorporated by reference.

BACKGROUND

When well fluid is produced from a subterranean formation, the fluid typically contains particulates, or "sand." The production of sand from the well typically is controlled for such purposes as preventing erosion and protecting upstream equipment. One way to control sand production is to install screens in the well. As an example, the sand screen may include a cylindrical mesh that is placed inside the borehole of the well where well fluid is produced. As another example, the sand screen may be formed by wrapping wire in a helical pattern with a controlled distance between each adjacent winding.

The sand screen may be part of a completion assembly to regulate the flow produced well fluid. In addition to one or multiple completion, the sand screen assembly may include a base pipe and one or more inflow control devices (ICDs) that regulate the flow of the produced well fluid into an interior space of the base pipe.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In accordance with an example implementation, an apparatus that is usable with a well includes a housing and a body. The housing includes an inlet and an outlet, and a fluid flow is communicated between the inlet and outlet. The body disposed inside the housing to form a fluid restriction for the fluid flow. The body includes an opening therethrough to divert a first portion of the fluid flow into a first fluid flow path; and a first surface to at least partially define the first fluid flow path. The body is adapted to move to control fluid communication through the first flow path based at least in part on at least one fluid property of the flow.

In accordance with another example implementation, an apparatus includes a screen, a base pipe and a flow control device. The base pipe includes a central passageway and at least one port to communicate a fluid flow into the central passageway after passing through the screen. The flow control device regulates the fluid flow and includes a housing and a floating body that is disposed inside the housing. The housing has an inlet to receive the fluid flow and an outlet to provide the fluid flow. The body moves to form a fluid restriction for the fluid flow based at least in part on a fluid property of the fluid flow. The body includes an opening therethrough to divert a portion of the fluid flow into a diverted fluid flow path having a cross section that varies with movement of the body; and a surface to face away from the inlet to at least partially define the diverted fluid flow path.

In accordance with another example implementation, a technique that is usable with a well includes downhole in the well, communicating a fluid flow to a flow control device that contains a movable body to cause a first force to be exerted on the body; diverting at least part of the fluid flow through an opening of the body to a laminar flow channel to cause a second force that opposes the first force to be exerted on the body based on one or more fluid properties of the diverted fluid flow; and using movement of the body in response to the first and second forces to control a mixture of fluids entering a production tubing string.

In accordance with yet another example implementation, an apparatus that is usable with a well includes a base pipe that is concentric about a longitudinal axis and an inflow control device to regulate a flow into the base pipe. The inflow control device includes at least one arcuate body that is disposed outside the base pipe to form a fluid restriction for the fluid flow. The arcuate body includes an inner surface to at least partially define a fluid flow path, and the body is adapted to radially move with respect to the longitudinal axis to control fluid communication through the fluid flow path based at least in part on at least one fluid property of the flow.

Advantages and other features will become apparent from the following drawing, description and claims.

DETAILED DESCRIPTION

In the following description, numerous specific details are set forth but implementations may be practiced without these specific details. Well-known circuits, structures and techniques have not been shown in detail to avoid obscuring an understanding of this description. "An implementation," "example implementation," "various implementations" and the like indicate implementation(s) so described may include particular features, structures, or characteristics, but not every implementation necessarily includes the particular features, structures, or characteristics. Some implementations may have some, all, or none of the features described for other implementations. "First", "second", "third" and the like describe a common object and indicate different instances of like objects are being referred to. Such adjectives do not imply objects so described must be in a given sequence, either temporally, spatially, in ranking, or in any other manner. "Coupled" and "connected" and their derivatives are not synonyms. "Connected" may indicate elements are in direct physical or electrical contact with each other and "coupled" may indicate elements co-operate or interact with each other, but they may or may not be in direct physical or electrical contact. Also, while similar or same numbers may be used to designate same or similar parts in different figures, doing so does not mean all figures including similar or same numbers constitute a single or same implementation.

Figure 1:
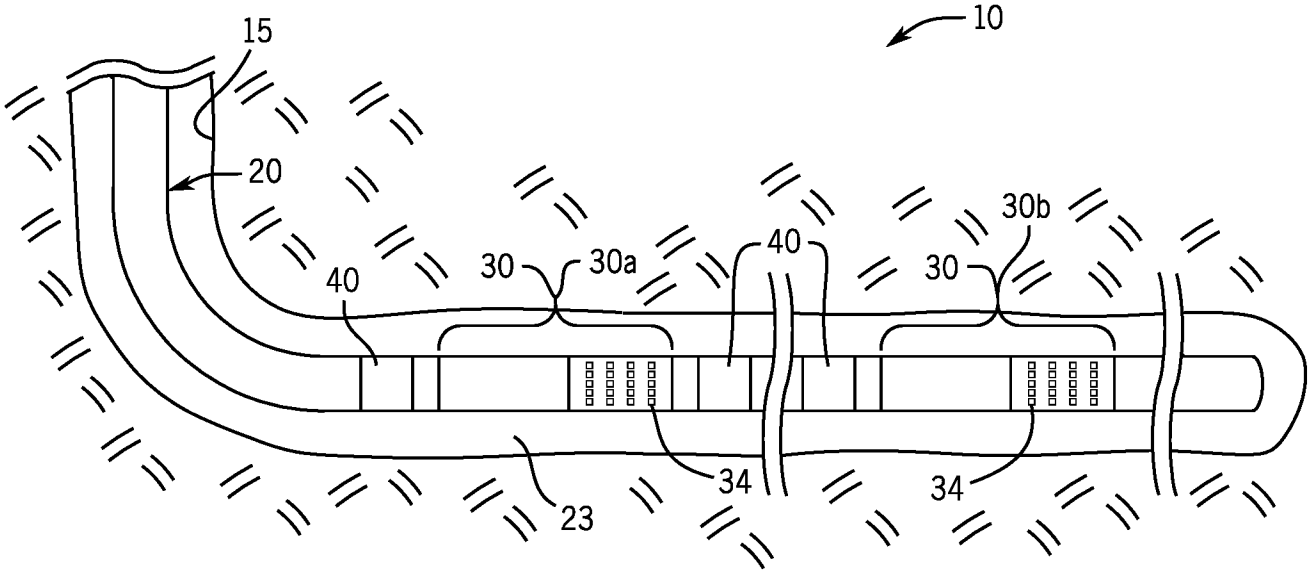
FIG. 1 is a schematic diagram of a well according to an example implementation.

Referring to FIG. 1, in accordance with implementations, a well system 10 may include a deviated or lateral wellbore 15 that extends through one or more formations. Although the wellbore 15 is depicted in FIG. 1 as being uncased, the wellbore 15 may be cased, in accordance with other implementations. Moreover, the wellbore 15 may be part of a subterranean or subsea well, depending on the particular implementation.

As depicted in FIG. 1, a tubular completion string 20 extends into the wellbore 15 to form one or more isolated zones for purposes of producing well fluid or injecting fluids, depending on the particular implementation. In general, the tubular completion string 20 includes completion screen assemblies 30 (exemplary completion screen assemblies 30*a* and 30*b* being depicted in FIG. 1), which either regulate the injection of fluid from the central passageway of the string 20 into the annulus or regulate the production of produced well fluid from the annulus into the central passageway of the string 20. In addition to the completion screen assemblies 30, the tubular string 20 may include packers 40 (shown in FIG. 1 their unset, or radially contracted states), which are radially expanded, or set, for purposes of sealing off the annulus to define the isolated zones.

For the following discussion, it is assumed that the string 20 receives produced well fluid and contains devices to regulate the mixture of produced fluids received into the string 20, although the concepts, systems and techniques that are disclosed herein may likewise be used for purposes of injection, in accordance with further implementations.

For the example implementation of FIG. 1, each completion screen assembly 30 includes a sand screen 34, which may be constructed to support a surrounding filtering gravel substrate (not depicted in FIG. 1). The sand screen 34 allows produced well fluid to flow into the central passageway of the string 20 for purposes of allowing the produced fluid to be communicated to the surface of the well. Before being used for purposes of production, the tubular completion string 20 and its completion screen assemblies 30 may also be used in connection with at least one downhole completion operation, such as a gravel packing operation to deposit the gravel substrate in annular regions that surround the sand screens 34, in accordance with example implementation. This includes both α-wave/β-wave gravel packing operations and alternate path gravel packing operations. In alternate path gravel packing, the completion string assemblies and completion screen assemblies may include shunt tubes, packing tubes and the like to deliver the gravel packing carrier fluid to wellbore to multiple points along the completion string assembly to form the gravel pack.

Figure 2A:
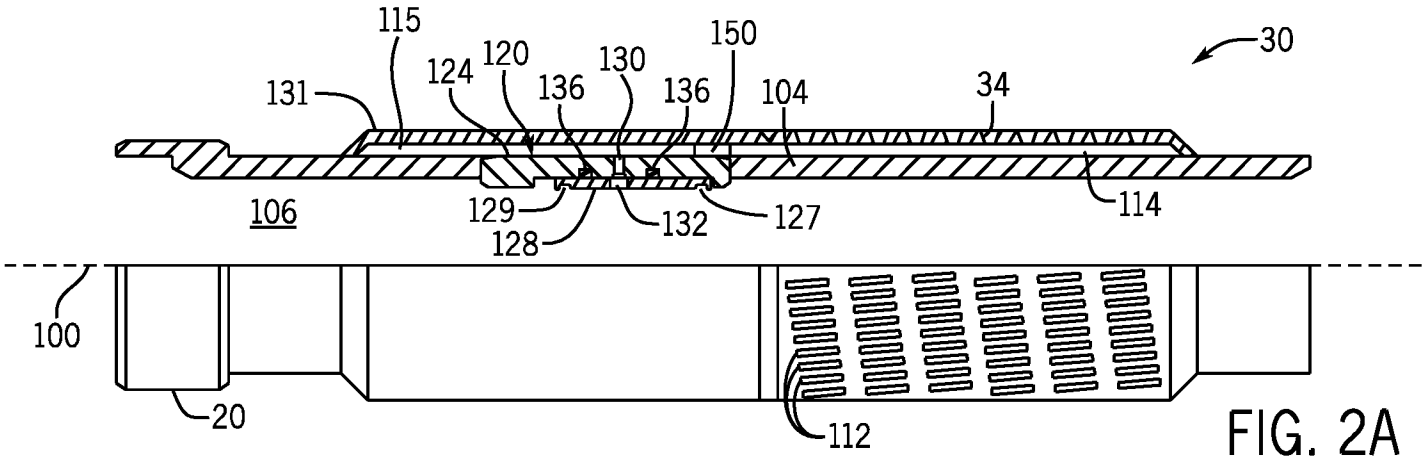
FIGS. 2A and 2B are schematic diagrams of a completion screen assembly having an inflow control device (ICD) illustrating open (FIG. 2A) and closed (FIG. 2B) states of the assembly according to an example implementation.

Referring to FIG. 2A in conjunction with FIG. 1, in accordance with some implementations, each completion screen assembly 30 includes a base pipe 104 that is concentric about a longitudinal axis 100 and forms a portion of the tubular string 20; and the assembly's sand screen 34 circumscribes the base pipe 104 to form an annular fluid receiving region 114 between the outer surface of the base pipe 104 and the interior surface of the sand screen 34. The completion screen assembly 30 may also include a sleeve valve 120 (as an example) that forms part of the base pipe 104 (and tubular string 20) for purposes of controlling fluid communication between the central passageway of the base pipe 104 (and tubular string 20) and an annular fluid receiving region 115.

In accordance with example implementations, the completion assembly 30 includes an annular barrier that contains one or multiple inflow control devices (ICDs) 150. As described herein, the ICD 150 contains a floating or movable body that moves in response to one or more fluid properties of the incoming fluid flow to regulate a mixture of the flow that is communicated into the string 20). More specifically, the ICD 150 enhances the flow of a desirable fluid (crude oil, for example), while inhibiting, or choking, the flows of undesirable fluids, such as gas or water.

For the example implementation shown in FIG. 2A, the ICD 150 is disposed in an annular barrier and oriented such that ICD's inlet receives an axial flow from the region 114, and the ICD's outlet provides an axial flow to the region 115. The annular receiving region 115 is the region between the base pipe 100 and a solid part 131 of the sand screen 34; and the annular receiving region 115 receives fluid flow through the ICD(s) 150. However, it is understood that the ICD 150 (as well as other ICDs 150) may be installed in other orientations and may be installed in devices other than annular barriers, in accordance with further example implementations. For example, in accordance with further example implementations, the ICD 150 may be installed in a radial port or recessed opening of a base pipe of a completion assembly, such that the ICD 150 controls the radial flow of fluid between region surrounding the assembly and a central passageway of the assembly.

For the example implementation that is depicted in FIG. 2A, the sleeve valve 120 includes a housing 124 that forms part of the base pipe 104 and has at least one radial port 130 to establish fluid communication between an annular fluid receiving region 115 and the central passageway of the base pipe 104. The sleeve valve 120 also includes an interior sliding sleeve 128 that is concentric with and, in general, is disposed inside the housing 124. As its name implies, the sliding sleeve 128 may be translated along the longitudinal axis of the base pipe 104 for purposes of opening and closing radial fluid communication through the radial port(s) 130. In this manner, the sliding sleeve 128 contains at least one radial port 132 to allow radial fluid communication through the port(s) 132 (and port(s) 130) when the sleeve 128 is translated to its open position. When the sliding sleeve 128 is translated to its closed position (see FIG. 2B), seals 136 (o-rings, for example), which are disposed between the outer surface of the sleeve 128 and the inner surface of the housing 124 isolate the ports 130 and 132 from each other, thereby blocking off fluid communication through the sleeve valve 120.

The sleeve 128 may be translated between its open (FIG. 2A) and closed (FIG. 2B) positions using a variety of different mechanisms, depending on the particular implementation. As a non-limiting example, the sleeve 128 may be translated to its different positions by a shifting tool that has an outer surface profile that is constructed to engage an inner surface profile (such as exemplary inner profiles 127 and 129, for example) of the sleeve 128. Other variations are contemplated and are within the scope of the appended claims.

Figure 2B:
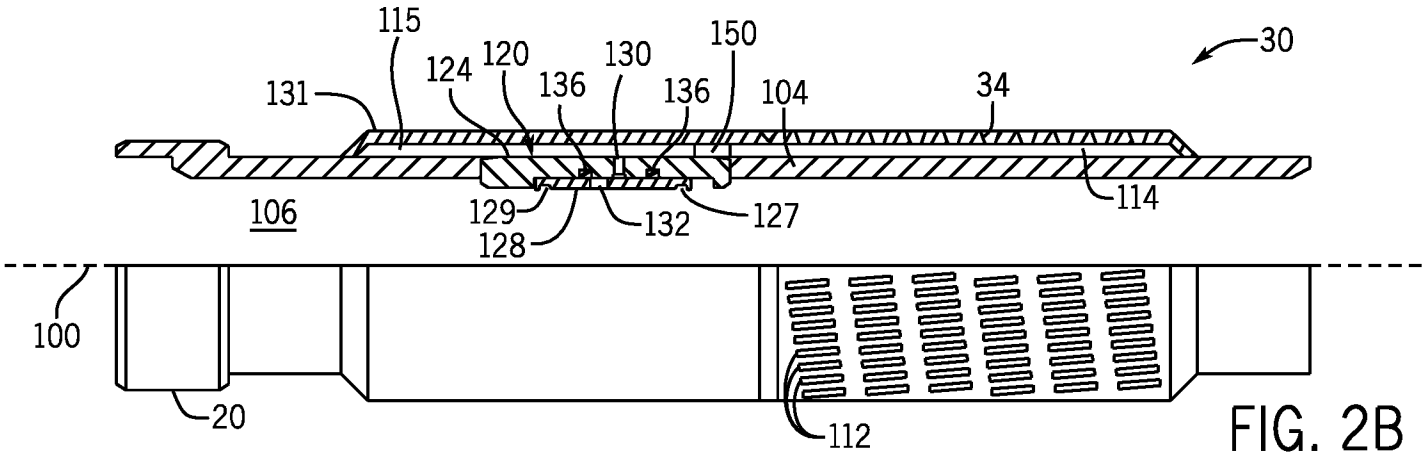

It is noted that FIGS. 2A and 2B depict a completion assembly in accordance with one of many possible implementations. For example, the sleeve valve 120 may be located uphole or downhole with respect to the sand screen 34; and in accordance with further example implementations, a completion assembly may not include a sleeve valve and may not include a screen. Thus, many variations are contemplated and are within the scope of the appended claims.

The ICDs 150 are used to regulate production so that the producing reservoir is generally uniformly depleted. In this manner, during oil production, the pressure distribution inside the completion tubing may not uniform due to internal frictional losses in the tubing and varying flow rates at different sections of the tubing. Additionally, formation permeabilities, which affect the production rate, may significantly vary from zone to zone.

For example, for lateral, or horizontal, wells, which have a heel, a near, and a toe, a far end, the differential pressure and depletion rate may vary. For example, the heel section of the completion may have an associated higher differential pressure and an associated faster depletion rate relative to the toe section, thereby giving rise to the "heel-to-toe" effect. A change in the oil/water interface and/or an oil/gas interface, called "coning," may lead to premature breakthrough of the "unwanted" fluids, such as gas or water.

Gas and water play important roles when left in place. In this manner, gas, due to its relatively higher compressibility, and hence, relatively higher stored energy, serves as a driver to displace oil in the formation. Water serves the roll of lifting the oil and is typically produced with the oil up to a 90% water cut. The production system may include measures to control water and gas production, as breakthrough of the gas means (due to its higher mobility) that the gas is primarily produced, which results in loss of the energy of the gas cap, which, in turn, reduces the "push" of the oil. The same principle applies to regulating the production of water, except that measures typically are used for purposes of inhibiting gas production in significant scale, whereas water production is controlled to a lesser degree.

Since water, due to its lower viscosity, and gases, due to both their lower viscosity and density, flow through the formation with lower resistance than oil, at some point, water and gases begin to dominate the volume fraction of the produced mixture, thereby putting additional burden on the above-ground separators and recycling systems. This may lead to premature abandonment of partially depleted reservoirs, leaving the majority of the oil near the completion unproduced, which, in turn, strongly affects well profitability.

In accordance with example systems and techniques that are disclosed herein, the ICD 150 has a single moving part, a body, which moves to adjust of the flow rate of a fluid flow based on one or more properties of the fluid, such as fluid viscosity and fluid density. For the specific example implementations that are described herein, the ICD 150 is used for proposes of controlling production. However, it is understood that a device similar to the ICD may be used to control injection, e.g. steam injection, gas injection, or water injection, in accordance with further, example implementations. Where the ICD's disclosed herein are used to control injection rather than production, any of the disclosed ICD's 150, 400, 500, 1200, etc. may be installed in completion screen assembly 30, base pipe, etc. such that fluids flowing from interior of the screen assembly 30 or base pipe to the formation 15 are controlled by the ICD. For example, the ICD may positioned in a reverse direction from the production arrangement such that injection fluids flowing from the interior of the screen assembly flow through the ICD's inlet and exit it's outlet before reaching the formation.

In accordance with example implementations, the ICD 150 is constructed to choke relatively low viscosity fluids, such as gas and water, and enhance the flow of relatively higher viscosity fluids, such as crude oil. In other words, in accordance with example implementations, the ICD 150 is constructed to reverse the natural tendency of fluids under pressure gradients to produce a higher flow rate for a low viscosity, low density fluid and produce a relatively low flow rate for higher viscosity, higher density fluids in porous media, such as formation rock, pipes and flow control nozzles.

The laminar flow regime of oil flow in porous rock of a reservoir may be described by the Darcy equation as follows:

$$\Delta P = \frac{\mu}{k}\frac{Q}{A}, \qquad \text{Eq. 1}$$

where "ΔP" represents the pressure gradient vector; "μ" represents the dynamic fluid viscosity; "k" represents the formation permeability; "Q" represents the volumetric flow rate; and "A" represents the cross-sectional area of the flow path. As follows from Eq 1, the hydraulic resistance in a reservoir is linearly proportional to the fluid viscosity and is not a function of fluid density.

For a laminar flow in a two-dimensional (2-D) flow channel, a spatial pressure gradient $$\left(\frac{dP}{dx}\right)$$

may be described as follows:

$$\frac{dP}{dx} = \frac{12\mu}{h^3}q, \quad \text{Eq. 2}$$

where "q" represents the volumetric rate per unit of channel width; and "h" represents the channel height. Similar to the porous media flow described above in Eq. 1, Eq. 2 indicates that the hydraulic resistance in a 2-D laminar channel is linearly proportional to the fluid viscosity and is not a function of fluid density. It is noted that in Eq. 2, the h channel height has a relatively strong effect on the pressure gradient, which is inversely proportional to the channel height cubed. The effect of the channel height, h, on the pressure gradient is used in the ICD 150, as further described herein.

For a flow through a conventional nozzle, which does not contain the movable body of the ICD 150, the differential pressure for relatively high Reynolds number flow is generally independent of fluid viscosity, as described below:

$$\Delta P = K_L \rho \frac{(Q/A)^2}{2}. \quad \text{Eq. 3}$$

In Eq. 3, "$K_L$" represents the nozzle loss coefficient; and "ρ" represents the fluid density. The viscosity represents the second order effect on the loss coefficient. Additionally, Eq. 3 indicates that pressure drop becomes becomes proportional to the fluid density and the flow rate squared.

Figure 3:
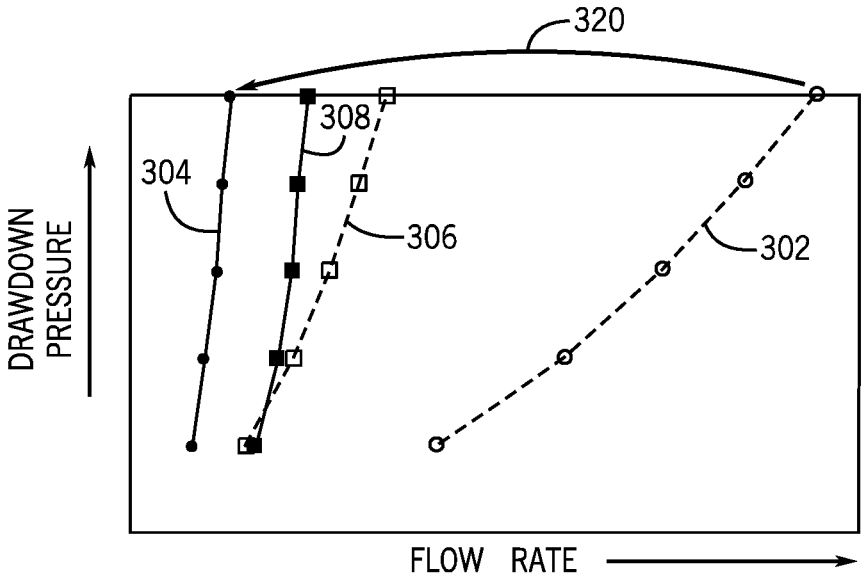
FIG. 3 illustrates drawdown pressures versus flow rates for a nozzle and for the ICD according to an example implementation.

For a conventional nozzle, FIG. 3 depicts a drawdown pressure versus flow rate graph 302 for a gas and a drawdown pressure versus flow rate graph 306 for a light oil. In some embodiments, the ICD 150 disclosed herein may make the flow of gas less dominant, as illustrated by a shift 320 to produce corresponding gas 304 and light oil 308 graphs. As can be seen from FIG. 3, using the ICD 150 disclosed herein, the oil flow has a higher associated flow rate, comparing graphs 308 (for the oil flow) and 304 (for the gas) for the same drawdown pressure.

Figure 4A:
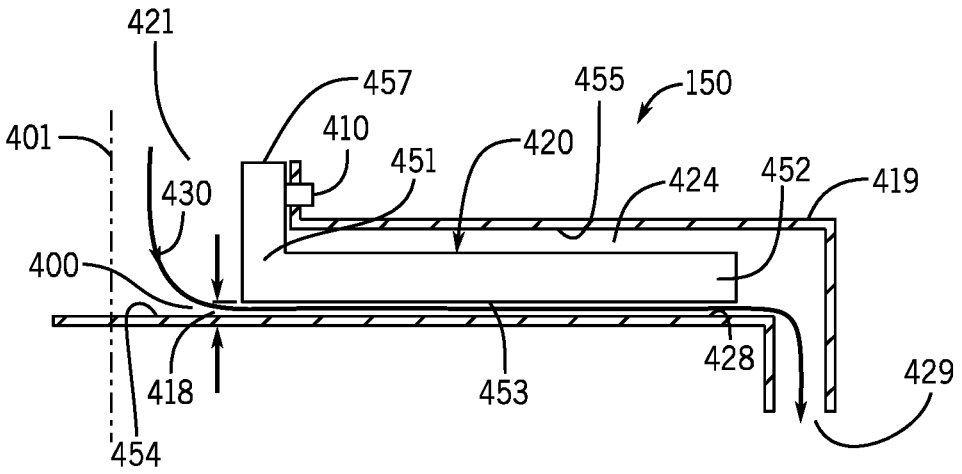
FIG. 4A is a partial cross-sectional view of a single flow ICD according to an example implementation.

FIG. 4A depicts the ICD 150 in accordance with an example implementation. It is noted that FIG. 4A depicts a partial right side cross-sectional view of the ICD 150, with it being understood that the left side cross-sectional view of the ICD 150 may be obtained by mirroring the right side view about an axis 401 of the ICD 150. FIG. 4A depicts a "single flow" ICD implementation, in that the ICD 150 receives a single incoming axial flow 430 and directs the flow 430 into a radial flow channel 428. The flow exits the ICD 150 at one or more outlets 429 of the ICD 150. A floating body, or movable body, 420 of the ICD 150 moves in response to one or more fluid properties of the flow 430 to controllably restrict the cross-sectional flow area of the radial flow channel 428 and as such, controllably restrict the flow through the ICD 150.

Turning to the more specific details, the movable body 420 contains a central opening 421 that circumscribes the axis 401 and receives the incoming flow 430. In particular, the body 420 includes a central hub 451 that has an axial bore that forms the opening 421. The body 420 further includes a flange 452 that radially outwardly extends from the hub 451. The radial flow channel 428 is formed between a downwardly facing surface 453 of the flange 452 (i.e., a surface opposed from the direction in which the flow 430 enters the ICD 150) and an upwardly facing surface 454 of a housing 419 of the ICD 150. For this example implementation, the hub 451 is sealed to the housing 419 by a corresponding fluid seal element 410 (an o-ring, for example). Due to this fluid seal, in an upper region 424 is created above the flange 452, which has a pressure that is generally the same as the pressure at the outlet(s) 429.

As can be seen from FIG. 4A, the cross-sectional flow area of the radial flow channel 428 is a function of an axial gap 418 between the flange's downwardly facing surface 453 and the housing's upwardly facing surface 454. Thus, axial movement of the body 420 controls the extent of the axial gap 418. The ICD 150 uses the effect of pressure drop distribution between an entrance pressure loss and a frictional pressure loss in the relatively small radial flow channel 428 (analogous to the phenomenon, in the field of turbomachinery annular seals called, the "Lomakin effect") to control the flow rate through the ICD 150.

More specifically, the pressure of the incoming fluid flow 430 exerts pressure on an upwardly facing surface 457 of the hub 451 to exert a corresponding downward acting force on the movable body 420, and the fluid flow in the radial flow channel 428 exerts pressure on the downwardly facing surface 453 of the flange 452 to exert a corresponding upward force on the movable body 420. The net force resulting from these upward and downwardly acting forces, in turn, controls the cross-sectional flow area of the radial flow channel 428 and thus, controls the extent of the fluid restriction that is imposed by the ICD 150. The movable body 420 may be considered floating in the sense that it moves independently from the housing 419, not necessary that it floats based on buoyancy.

Figure 4B:
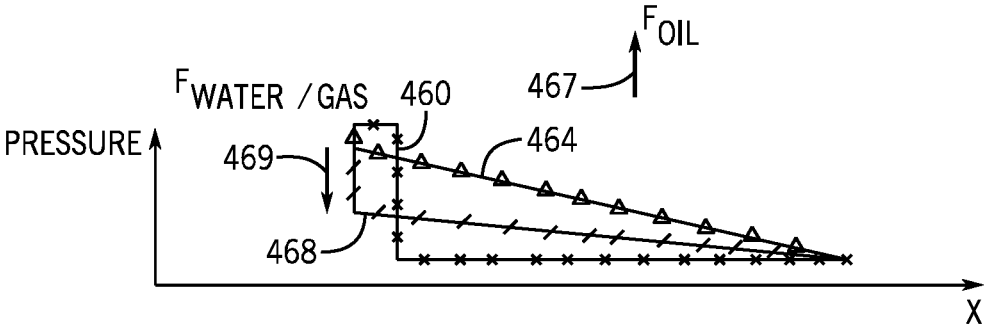
FIG. 4B illustrates pressures and forces for the single flow ICD according to an example implementation.

For a given axial gap 428, a higher viscosity fluid in a laminar regime generally exhibits linearly proportional higher frictional losses in the radial flow channel 428, thereby correspondingly exhibiting a smaller entrance loss. Referring to FIG. 4B in conjunction with FIG. 4A, a pressure 460 that is exerted on the upper the hub 451 tends to push the body 420 downwardly along the axis 401. FIG. 4B depicts a pressure 464 that is exhibited by a relatively high viscosity fluid (such as oil, for example) flowing in the radial flow channel 428. Due to the higher frictional losses along the radial flow channel 428 and the smaller entrance pressure loss of the relatively high viscosity fluid, a net upward force 467 is exerted on the movable body 420, which lifts the body 420 upwardly and increases the cross-sectional area of the channel 428.

A relatively low viscosity fluid (such as water or gas) generates lower frictional losses along the radial flow channel 428 and correspondingly results in a relatively larger pressure drop at the inlet of the channel 428. FIG. 4B depicts a pressure 468 exerted by such a lower viscosity fluid along the radial flow channel 428. The lower viscosity fluid, due to the above-described lower losses along the radial flow channel 428 and the higher entrance loss results in a downwardly acting net force 469, which causes the movable body 420 to find an equilibrium position at a smaller gap 418, thereby choking the flow 430.

Figure 5A:
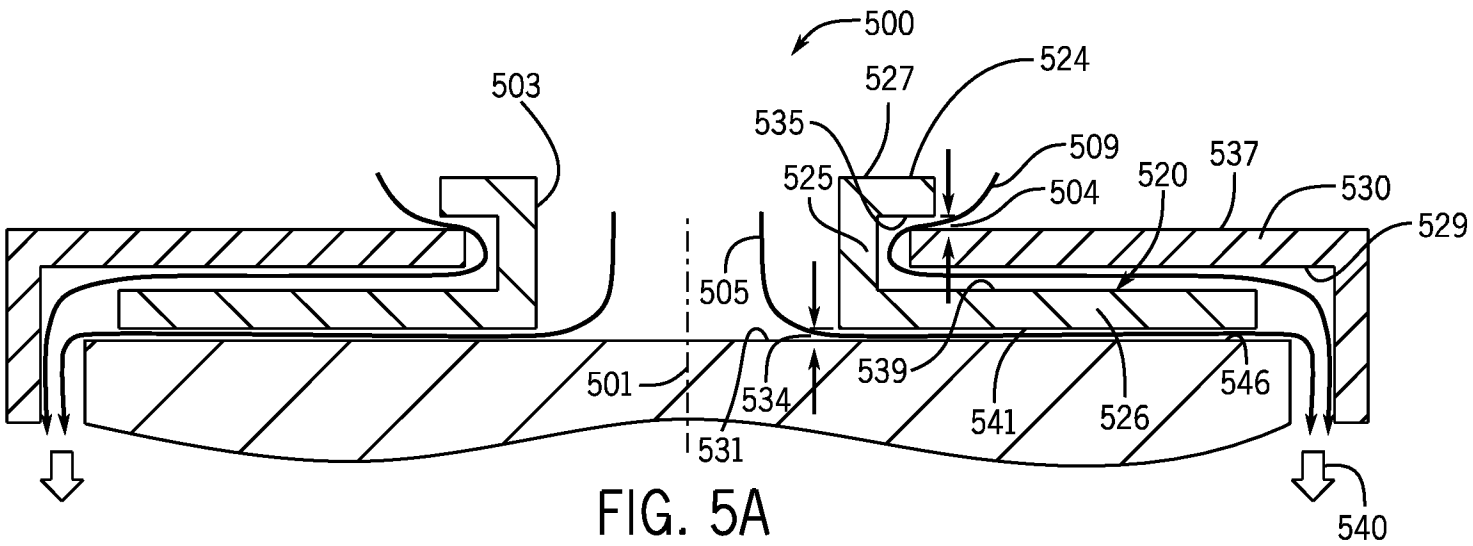
FIG. 5A is a cross-sectional view of a double flow ICD illustrating a response of the ICD to an oil flow according to an example implementation.

Referring to FIG. 5A, in accordance with further example implementations, the single flow ICD 150 that is described above may be replaced with a "double flow" ICD 500. Similar to the single flow ICD 150, the double flow ICD 500 has a movable body 520 that moves in response to fluid properties of an incoming flow for purposes of regulating the degree to which the flow is restricted by the ICD 500. Unlike the single flow ICD 150, the double flow ICD 500 does not have a fluid seal between its movable body 520 and housing 530. Instead, the ICD 500 diverts, or divides, the incoming flow to the ICD 500 into two flows: a first flow 505 that is communicated through a central inlet, or opening 503, of the movable body 520 of the ICD 500 and into a radial flow channel 546 (similar to the ICD 150); and a second flow 509 that is directed around the outside of the body 520. The two flows 505 and 509 produce forces, which control axial movement of the body 520 and correspondingly regulate the cross-sectional area of the radial flow channel 546 and the cross-sectional area that is associated with the flow 509.

Turning to the details, in accordance with example implementations, the movable body 520 includes a relatively larger lower flange 526 (a circular disk-shaped flange, for example), a central hub 525 and a relatively smaller upper flange 524 (a circular disk-shaped flange, for example). The upper 524 and lower 526 flanges each extends radially away from the hub 525, and the hub 525 circumscribes an axis 501 of the ICD 500 to form the central inlet, or opening 503, of the body 520. The flow 509 is directed radially inwardly under the upper flange 524 in a gap 504 that is formed between a downwardly facing surface 535 of the upper flange 524 and an upwardly facing surface 537 of the housing 520, axially along the hub 525 and radially outwardly between facing surface 539 of the lower flange 526 and a downwardly facing surface 529 of the housing 530. The radial flow channel 546 is formed between a downwardly facing surface 541 of the lower flange 526 and an upwardly facing surface 531 of the housing 530. The two flows 505 and 509 exit the ICD 500 at one or more outlets of the ICD 500 to form a discharge flow 540.

Figure 5B:
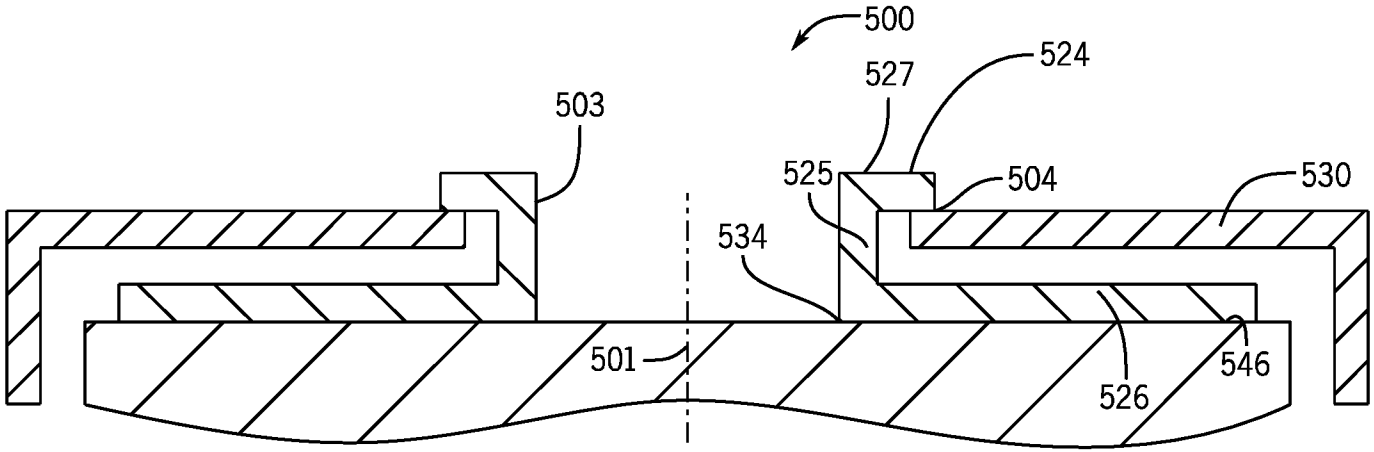
FIG. 5B is a cross-sectional view of the double flow ICD illustrating a response of the ICD to a water and/or gas flow according to an example implementation.
Figure 5C:
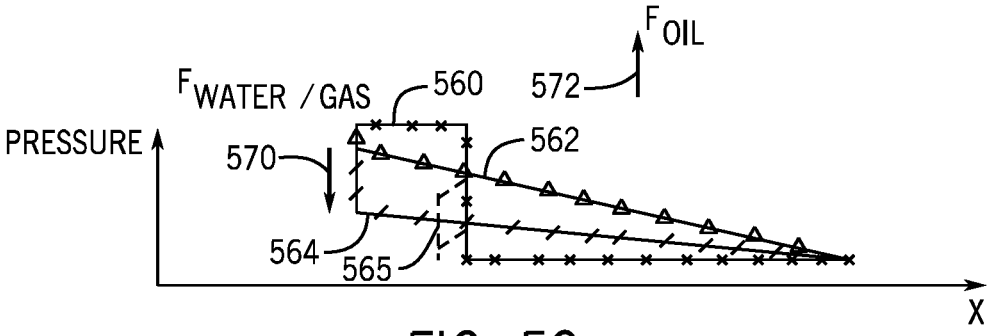
FIG. 5C illustrates pressures and forces for the double flow ICD according to an example implementation.

Fluid pressure acts on the upwardly facing surface 527 of the upper flange and on the upwardly facing surface 539 of the lower flange 526 to exert a downward force on the body 520; and fluid pressure acts on the lower surface 541 of the lower flange 526 (due to the radial flow channel 546) to exert an upward force on the body 520. More specifically, referring to FIG. 5C in conjunction with FIG. 5A, a pressure profile 560 that is attributable to the flow 509 exhibits a relatively sharp drop off at the opening 504. For a fluid that has a relatively high viscosity (such as oil), as illustrated by pressure profile 562, a net force 572 is produced to lift the body 520 upwardly to increase flow through the ICD 500. For a relatively low viscosity fluid (such as water or gas), as illustrated by pressure profile 564 and depiction of the ICD 500 in FIG. 5B, less losses are incurred along the radial flow channel 546, resulting in a net force 570 that tends to decrease the gaps 504 and 534 to choke off the flow through the ICD 500.

It is noted that, as compared to the ICD 150, the ICD 500 may provide the advantages of allowing additional increase of the total flow for high viscosity fluids; the simultaneous shut off of all flow passages for low viscosity fluids; and the elimination of a sealing element, which may degrade in performance over time.

Analytical models are described below for the single flow ICD 150 and for the double flow ICD 500. For these analytical models, the pressure drop across the ICD and the friction factor for the ICD are modeled.

Figure 6:
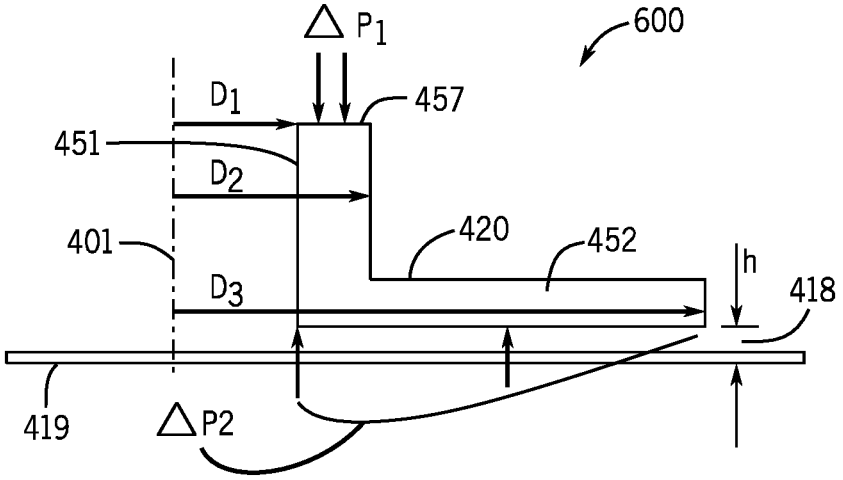
FIG. 6 is an illustration of parameters for an analytical model for the single flow ICD according to an example implementation.

First, for the ICD 150, a model 600 that is depicted in FIG. 6 may be used. For the model 600, "h" represents the axial gap 418, "ΔP1" represents the entrance pressure; "ΔP2" represents the viscous loss in the flow channel defined by the h axial gap 418; and the distances D1, D2 and D3 are defined as illustrated in FIG. 6.

In general, operation of the ICD may be described by the following set of equations. The force equilibrium of the floating body in the axial direction can be described as follows:

$$\Delta P_1 \frac{\pi}{4}(D_2^2 - D_1^2) = \Delta P_2 \frac{\pi}{4}(D_3^2 - D_1^2), \qquad \text{Eq. 4}$$

In Eq. 4 $<\Delta P_2>$ is the area averaged pressure under the floating ring.

Energy balance equation along the flow from inlet to the outlet can be written as follows:

$$\Delta P = K_{entrance}\rho\frac{V_{entrance}^2}{2} + \int_{D_1}^{D_3} f\rho\frac{V(D)^2}{2}\frac{dD/2}{2h(D)} + K_{exit}\rho\frac{V_{exit}^2}{2}, \qquad \text{Eq. 5}$$

In Eq. 5, velocity at each cross section is defined from the mass conservation as follows:

$$V = \frac{Q}{\pi D h}, \qquad \text{Eq. 6}$$

$K_{entrance}$ and $K_{exit}$ in Eq. 5 represent non-dimensional entrance and exit loss coefficients, respectively; and p represents the fluid density. Parameter f in Eq. 5 represents the Darcy frictional factor. For the laminar flow regime, the friction factor may be derived analytically for a 2-D channel as a function of the Reynolds number, Re, as described below:

$$f_{lam} = \frac{96}{Re}. \qquad \text{Eq. 7}$$

A 2-D passage may be related to the circular pipe flow using a hydraulic diameter, Dh, as follows:

$$D_h = \frac{4A}{P} = 2, \qquad \text{Eq. 8}$$

where "A" represents the area; and "P" represents the perimeter of the cross-section. Hence, Reynolds number for a 2-D passage may be described as follows:

$$Re = \frac{\rho V 2h}{\mu}, \qquad \text{Eq. 9}$$

where "μ" represents the fluid dynamic viscosity.

As a flow turns turbulent, various empirical models that describe flow behavior may be used to model the flow, as can be appreciated by one of ordinary skill in the art. In accordance with example implementations, a relatively simple non-iterative Blasius formula for turbulent flows in smooth pipes with Re<105 may be used, as described below:

$$f_{turb} = \frac{0.316}{Re^{1/4}}. \qquad \text{Eq. 10}$$

Equations 4-10, if combined, form two equations with two unknowns, Q and h, which can be solved analytically or numerically to predict ICD performance analytically and to size the ICD for the given operating conditions.

Figure 7:
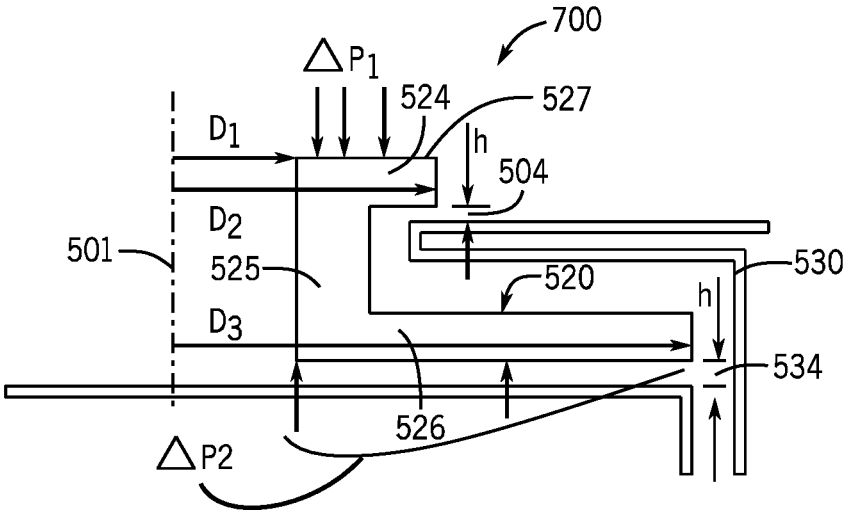
FIG. 7 is an illustration of parameters for an analytical model for the double flow ICD according to an example implementation.
Figure 8A:
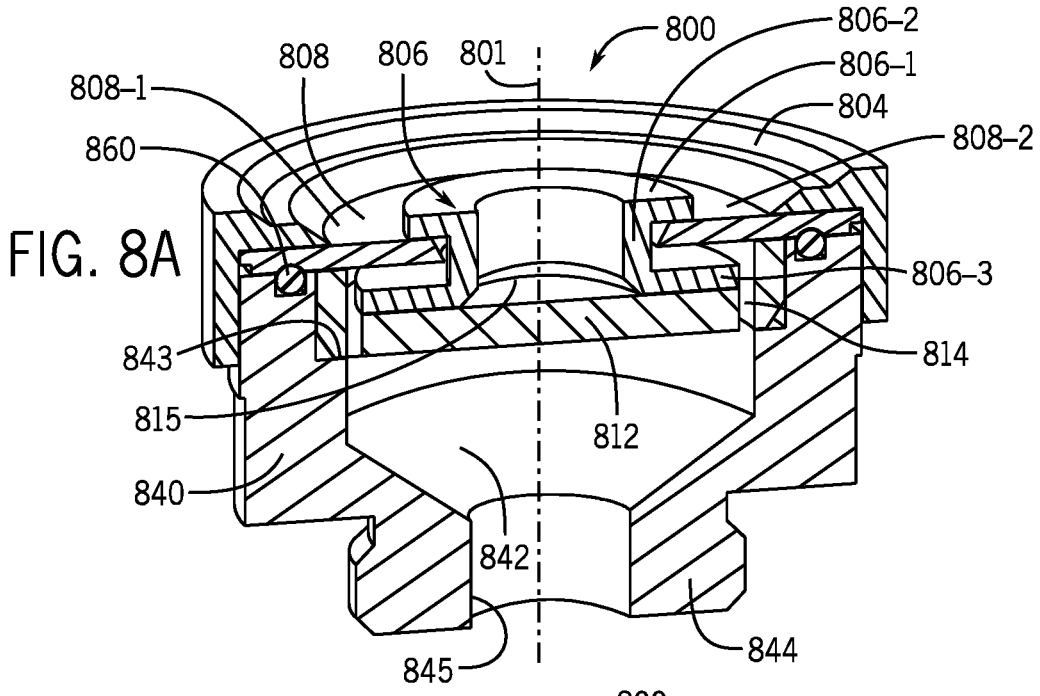
FIG. 8A is a cross-sectional view of a double flow ICD according to a further example implementation.
Figure 8B:
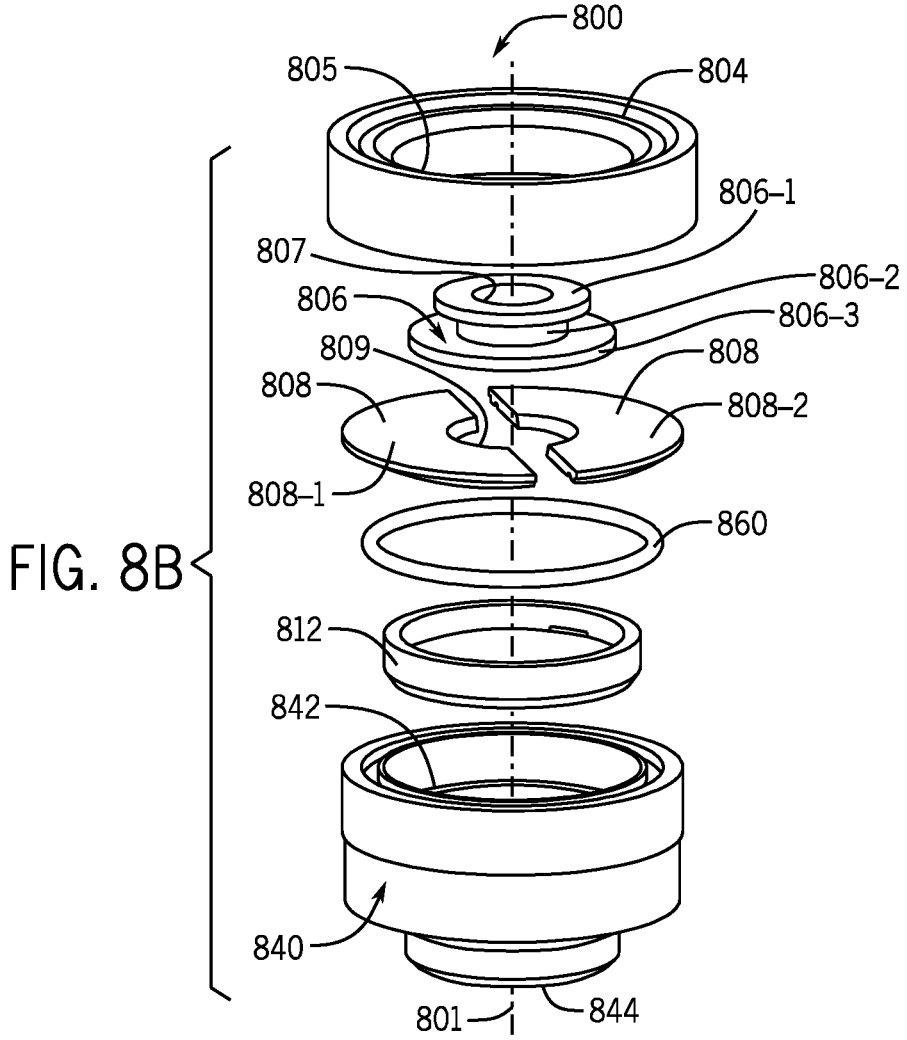
FIG. 8B is an exploded perspective view of the double flow ICD of FIG. 8A according to an example implementation.

For purposes of developing a model for the double flow ICD 500 (FIG. 5A), parameters may be defined for the ICD 500 pursuant to an illustration 700 of FIG. 7. The ICD 500 contains two flow passages, namely, the main passage, operating on the same principle as the single flow as the ICD 150, as described above, and the secondary passage, which replaces the seal of the ICD 150. The opening of the secondary passage is the same as in the main massage, h by design. However, due to its short length, the secondary passage may be modeled as an orifice with the loss coefficient, KL. The force balance model described above for the ICD 150 may be re-used for the ICD 500 by modeling the definition of the dimension D2 to be the outer diameter of the upper flange 524. Referring to FIGS. 8A and 8B, in accordance with example implementations, and a double flow ICD 800 includes a cup-shaped housing 840 that generally circumscribes a longitudinal axis 801. A lower end 844 of the housing 840 forms a discharge opening 845 for the ICD 800, and an upper end 842 that is constructed to receive the components of the ICD 800 in a chamber 842 of the housing 840. In this manner, as depicted in FIGS. 8A and 8B, these inner components include a cup 812 that is received on a shoulder 843 of the housing 840 and forms the lower boundary of the lower flow channel for the ICD 800. The cup 812 includes openings 814 to form corresponding discharge ports that open into the discharge 845 of the ICD 800. A mandrel 806, the "movable body" is disposed in the cup 812 and a divider 808 (formed from two separate sections 808-1 and 808-2, as depicted in FIG. 8B) circumscribes the hub 806-2 of the mandrel 806 for purposes of forming the two divided flows for the ICD 800.

As also shown in FIG. 8A, a fluid seal may be formed between the divider 808 and the cup 812 by a corresponding seal element, such as an o-ring 860. Among its features, the ICD 800 may include an upper cap 804 that is mounted on top of the housing 840. As depicted in FIG. 8B, the upper cap 804, in general, includes an opening 805 that forms the overall inlet of the ICD 800.

Figure 9A:
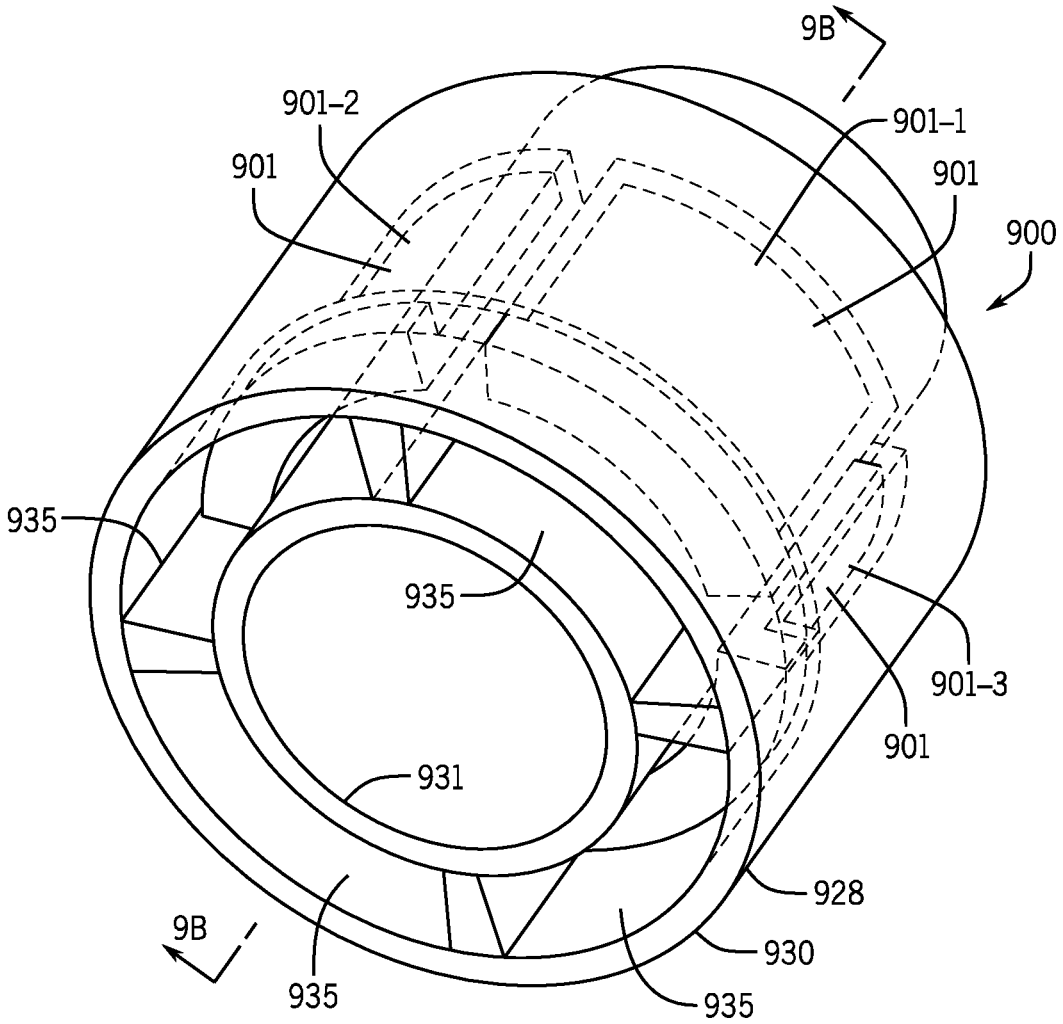
FIG. 9A is a perspective view of a tubular ICD element according to a further example implementation.
Figure 9B:
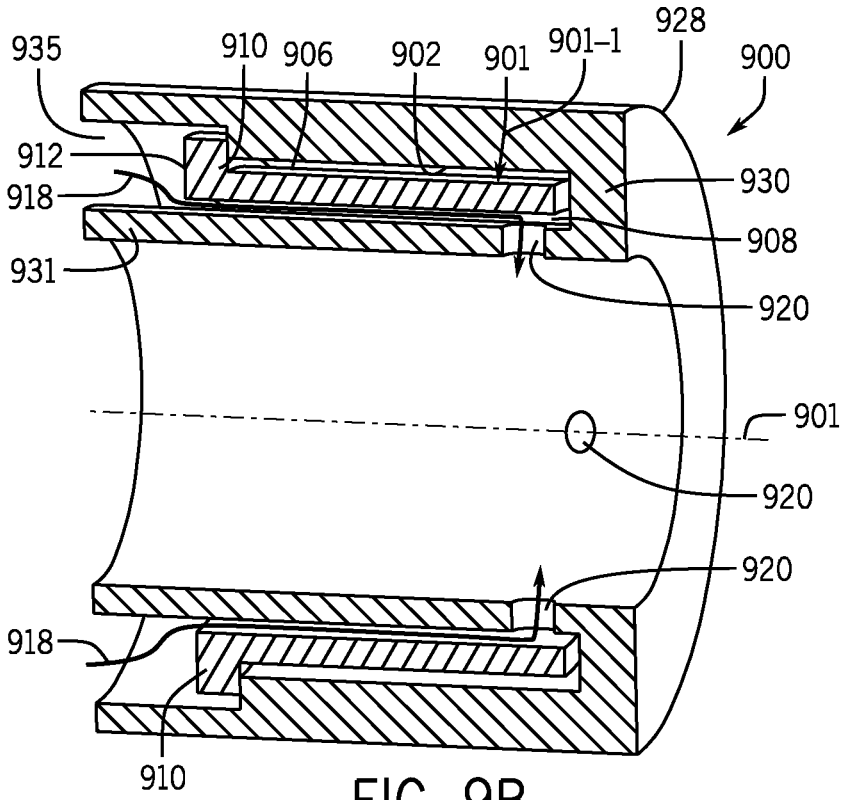
FIG. 9B is a cross-sectional view taken along line 9B-9B of FIG. 9A according to an example implementation.

Other implementations are contemplated, which are within the scope of the appended claims. For example, referring to FIGS. 9A and 9B, an ICD 900 includes arcuate bodies, or pads 901 (four pads 901-1, 901-2, 901-3 and 901-4, being depicted as examples), that are disposed in four corresponding annular chambers 935. As shown in FIG. 9A, the annular chambers are formed between an outer portion 930 of a base pipe 928 and an inner portion 931 of the base pipe 928. Referring to FIG. 9B, an incoming longitudinal flow forms corresponding longitudinal flows 918 that enter the chambers 935 are diverted inside corresponding flow channels created between the arcuate pads 901 and the inner portion 931 of the base pipe 928. Thus, each pad 901 moves in a radial direction to regulate the flow, which exits the base pipe 928 at outlets 920.

Figure 11A:
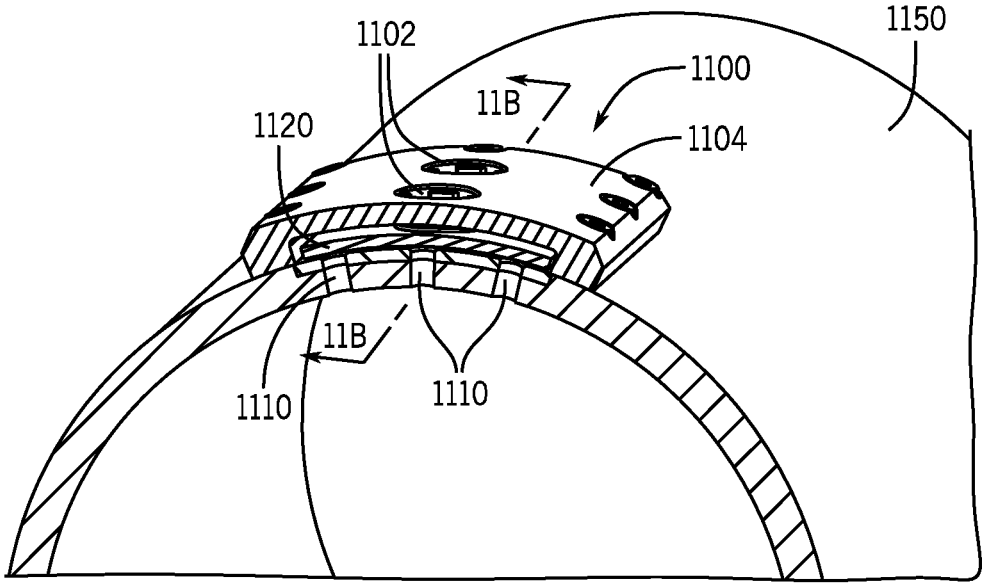
FIG. 11A is a perspective view of a tubular ICD element according to a further example implementation.
Figure 11B:
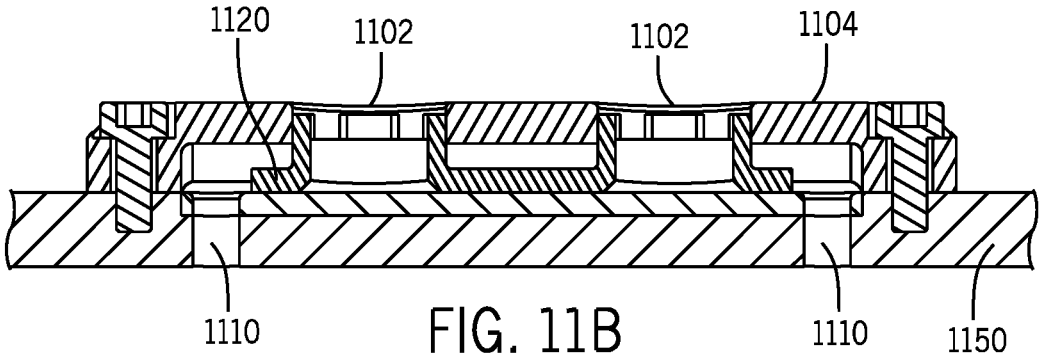
FIG. 11B is a cross-sectional view taken along line 11B-11B of FIG. 11A according to an example implementation.

As another example, FIGS. 11A and 11B depict an ICD 1100 in which an arcuate movable body 1120 resides inside a housing 1104 that is attached to a base pipe 1150. The housing 1104 contains inlets 1102 that receive an incoming flow that is regulated by movement of the movable body 1120. The flow exits the ICD 1100 at outlets 1110 of the ICD 1100.

Figure 12:
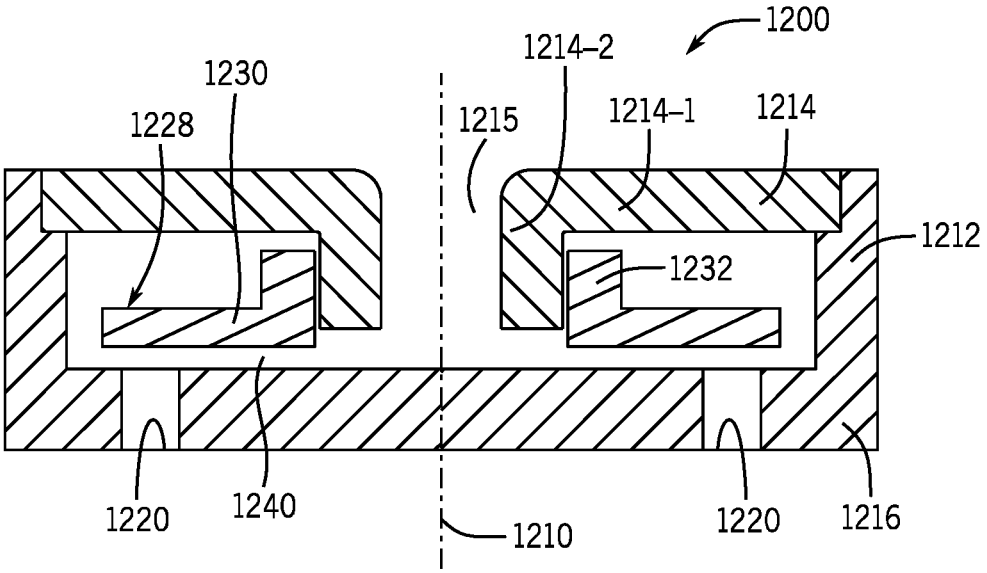
FIG. 12 is a cross-sectional view of a single flow ICD according to a further example implementation.

Referring to FIG. 12, in accordance with some implementations, a single flow ICD 1200 includes a floating, or moveable, body 1228 that is positioned inside a chamber formed between a lower housing 1216 and an upper housing, cap 1214. In this manner, the lower housing 1216 may include a base portion and includes outlets 1220 for the ICD 1200 and a sidewall 1212 that circumscribes an axis 1210 of the ICD 1200 and receives the cap 1214. The body 1228 includes a hub 1232 that circumscribes the axis 120 and a radial disk-shaped portion 1230 that forms a flow channel 1240 between the body 1228 and an upper surface (for the orientation depicted in FIG. 12) of the base portion of the lower housing 1216 and the lower surface of the portion 1230. The cap 1214 has an inlet 1215 that receives the incoming flow for the ICD 1200.

Unlike the single flow ICD discussed above, the ICD 1200 does not include a seal element between the body 1228 and the housing. Instead, the cap 1214 has a radial disk-shaped portion 1214-1 that circumscribes the inlet 1215 and a longitudinally extending portion 1214-2 that circumscribes the inlet 1215. The longitudinally extending portion 1214-2, as depicted in FIG. 12, may extend inside the hub 1232 of the body 1228 to protect the body 1228 and direct the incoming fluid into the flow channel 1240.

Figure 13:
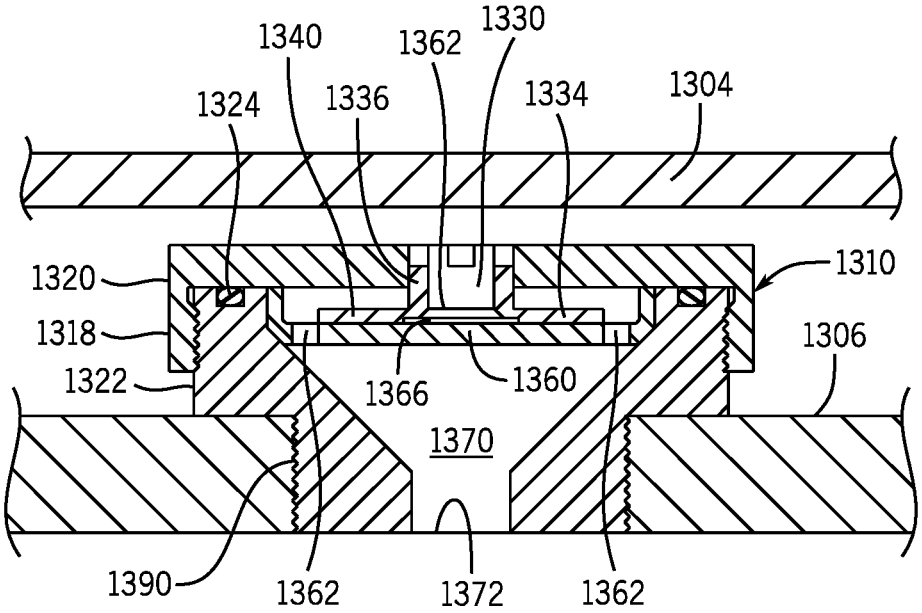
FIG. 13 is a cross-sectional view of an assembly including an ICD and base pipe according to an example implementation.

As another variation, in accordance with some implementations, an ICD similar to the ICD 800 of FIG. 8 may have outer threads that are constructed to mate with inner threads of a radial port of a base pipe. As a more specific example, FIG. 13 depicts an ICD 1310 that is received in a radial port 1390 of a base pipe 1306. As an example, a lower housing 1322 of the ICD 1310 may have external threads that mate with threads of the radial port 1390. As depicted in FIG. 13, the lower housing 1322 mates with an upper housing 1320 of the ICD 1310 that may extend over the lower housing 1322 to form a cap (as indicated at reference numeral 1318) and may be sealed to the upper housing 1320 (via a seal element, such as an o-ring 1324, for example).

The lower housing 1322 contains an internal chamber 1370 that narrows at its end closest to the base pipe to form a discharge 1372 for the ICD 1310. The chamber 1370 receives a divider 1360 that contains outlets 1362, and the divider 1360 forms a region of the ICD 1310 that contains a floating, or moveable, body 1340. The body 1340 has a hub 1336 that circumscribes an axis along which the ICD 1310 receives an incoming flow at the ICD's inlet 1330; and the body 1340 contains a disk-shaped portion 1334 to form a flow channel between the portion 1334 and the divider 1360. Movement of the body 1340 along the axis regulates the flow through the ICD 1310, similar to the other ICDs described herein.

Figure 10:
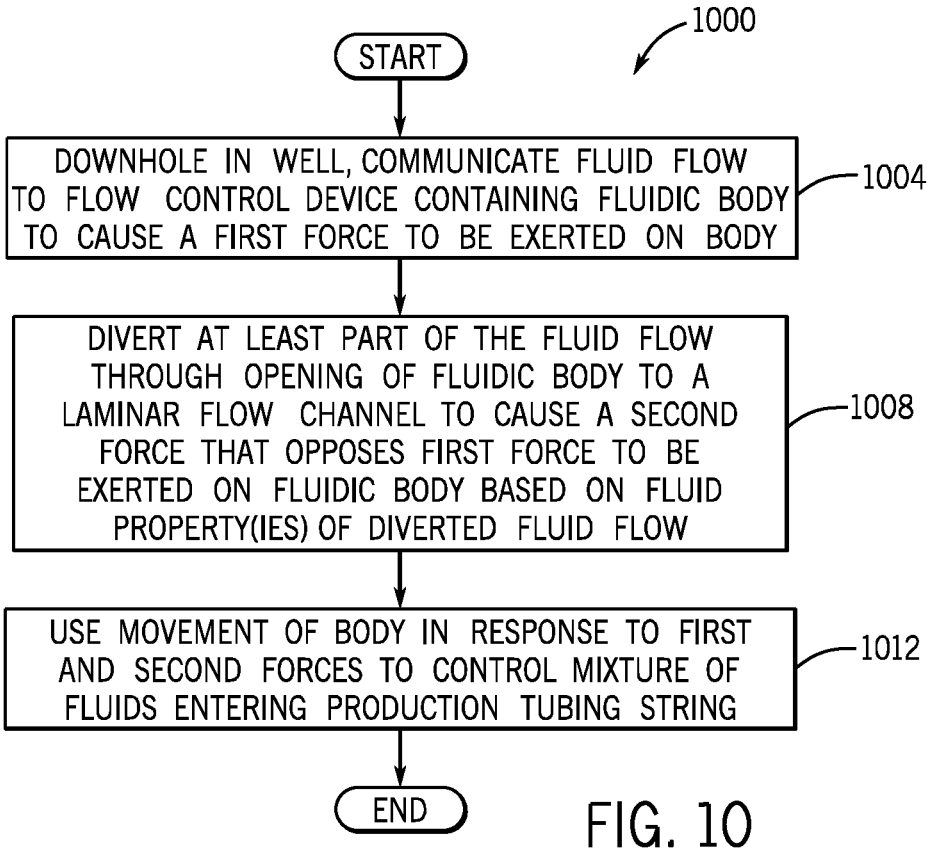
FIG. 10 is a flow diagram depicting a technique to use a floating body to control the mixture of fluids entering a production tubing string according to an example implementation.

The body 1340 contains features that allow balancing of the forces that are acting on the body 1340. More specifically, in accordance with example implementations, the body 1340 contains an inset portion 1366 on the surface of the body 1340, which faces the divider 1360. The body 1340 may also, or alternatively, have a chamfer 1362 in the transition between the hub 1336 and the surface of the body 1340, which faces the divider 1360. In this manner, the ICD 1310 for the example implementation of FIG. 13 has a combination of the chamfer 1362 and the inset portion 1366; and the ICD 800 (see FIG. 8A), as another example, has a chamfer 815 and no inset portion in its moveable body. Still referring to FIG. 13, these features may be appropriately dimensioned, in accordance with example implementations, to create an upward force (for the orientation that is depicted in FIG. 13) due to the fluid in the flow channel created by the body 1340 to oppose the downward force that is exerted on the body 1340 by the incoming fluid. In accordance with some implementations, the ICD 1310 may fail closed (i.e., the body 1340 may fail in a position that blocks flow through the ICD 1310). Moreover, the ICD 1310 may, through the features of the body 1340 (chamfer 1362 and/or inset portion 1366) cause the body 1340 to be lifted by relatively small flows to therefore open fluid communication through the ICD 1310 for such small flows. Thus, referring to FIG. 10, in accordance with example implementations, a technique 1000 includes, downhole in a well, communicating a fluid flow (block 1004) to a flow control device that contains a movable body to cause a first force to be exerted on the body. Pursuant to block 1008, at least part of the fluid flow is diverted through an opening of the body to a laminar flow channel to cause a second force that opposes the first force to be exerted on the body based on one or more fluid properties of the diverted fluid flow. Movement of the body in response to the first and second forces may be used to control the mixture of fluids that enter a production tubing string, according to block 1012.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. An apparatus usable with a well, comprising:

a housing comprising an inlet and an outlet, wherein a fluid flow is communicated between the inlet and outlet; and a body disposed inside the housing to form a fluid restriction for the fluid flow, the body comprising:

an opening therethrough to divert a first portion of the fluid flow into a first fluid flow path;

a first surface to at least partially define the first fluid flow path;

a hub comprising an axial bore that forms the opening and receives the first diverted portion of the fluid flow; and a first flange that extends radially away from the hub, the first flange comprising the first surface, and the first surface facing the housing to create the first fluid flow path in an axial gap between the first surface of the first flange and an upwardly facing surface of the housing, wherein the hub forms a second diverted portion of the fluid flow, the second diverted portion of the fluid flow being communicated outside of the opening to a second fluid flow path, the second fluid flow path being defined in part by a second surface of the first flange, wherein the first surface of the first flange is parallel to the second surface of the first flange, the body further comprising:

a second flange to radially extend away from the hub, wherein the first flange directs the first diverted portion of the flow away from the hub, wherein the second flange directs a second diverted portion of the flow toward the hub, and wherein the body is adapted to move to control fluid communication through the first flow path based at least in part on at least one fluid property of the flow.

2. The apparatus of claim 1, wherein the first surface of the body faces away from the inlet.

3. The apparatus of claim 1, wherein the fluid flow is communicated radially outward from the opening to the outlet.

4. The apparatus of claim 1, wherein the outlet comprises a plurality of openings in the housing.

5. The apparatus of claim 1, wherein:

the first surface of the body faces away from the inlet; and the first fluid flow path extends between the first surface and the housing.

6. The apparatus of claim 1, wherein the second surface of the first flange faces the inlet and the first surface of the first flange faces away from the inlet.

7. The apparatus of claim 1, wherein:

the second flange forms a first segment of a second fluid flow path;

the second flange directs the second diverted portion of the flow to the first segment of the second fluid flow path;

the hub forms a second segment of the second fluid flow path;

the hub directs the second diverted portion from the first segment of the second fluid flow path to the second segment of the second fluid flow path;

the first flange forms a third segment of the second fluid flow path; and the first flange directs the second diverted portion from the second segment of the second fluid flow path to the third segment of the second fluid flow path.

8. The apparatus of claim 1, wherein the first fluid flow path has an associated first pressure loss that is a function of the at least one fluid property, the opening having an associated second pressure loss, and the body is adapted to move in response to a net force on the body created by the first and second pressure losses.

9. The apparatus of claim 8, wherein the net force moves the body to relatively restrict the axial gap of the first fluid flow path in response to the fluid flow having an associated relatively lower viscosity, and the net force moves the body to relatively open the axial gap of the first fluid flow path in response to the fluid flow having an associated relatively higher viscosity.

10. The apparatus of claim 1, wherein the pressure exerted by the fluid in the first fluid flow path acts in a direction on the body associated with increasing a cross-sectional flow area of the first fluid flow path, and the body comprises a second surface, the apparatus further comprising:

a fluid sealing element to form a seal between the body and the housing to cause a pressure at the outlet to be communicated to the second surface of the body.

11. The apparatus of claim 1, wherein the housing has an outer profile adapted to mate with a profile associated with a radial port of a tubing string to control production of the flow from a region surrounding the tubing or control injection of the flow into the region.

12. The apparatus of claim 1, wherein the body is adapted to move to restrict fluid communication through the fluid flow path based at least in part on a viscosity of the flow.

13. The apparatus of claim 1 wherein a portion of the housing extends into the hub and circumscribes the inlet.

* * * * *